US006286629B1

(12) United States Patent
Saunders

(10) Patent No.: US 6,286,629 B1
(45) Date of Patent: Sep. 11, 2001

(54) LIFT-POSITIONING SYSTEM

(76) Inventor: David N. Saunders, 82 Industrial Park Dr., Saco, ME (US) 04072

( * ) Notice: Subject to any disclaimer, the term of this patent is extended or adjusted under 35 U.S.C. 154(b) by 0 days.

(21) Appl. No.: 09/244,236

(22) Filed: Feb. 3, 1999

(51) Int. Cl.[7] ..... B66B 3/00
(52) U.S. Cl. ..... 187/394; 254/122
(58) Field of Search ..... 187/391, 394; 318/626, 640, 646, 647, 648; 122/2, 12, 19, 141, 144, 147; 254/9 C, 10 C, 2 C

(56) References Cited

U.S. PATENT DOCUMENTS

| | | | | |
|---|---|---|---|---|
| 3,483,950 | | 12/1969 | Simpson . | |
| 4,122,957 | | 10/1978 | Allen et al. . | |
| 4,252,213 | | 2/1981 | Ekman . | |
| 4,427,095 | | 1/1984 | Payne et al. . | |
| 4,499,541 | | 2/1985 | Yuki et al. . | |
| 4,625,830 | * | 12/1986 | Wehmeyer et al. | 182/19 |
| 4,638,887 | * | 1/1987 | Kishi | 187/9 R |
| 4,683,990 | * | 8/1987 | Wright | 187/134 |
| 4,789,050 | * | 12/1988 | Evin | 187/134 |
| 4,869,341 | * | 9/1989 | Fitzgerald | 182/19 |
| 4,924,781 | * | 5/1990 | Span | 248/122 |
| 5,135,081 | | 8/1992 | Watt et al. . | |
| 5,695,173 | | 12/1997 | Ochoa et al. . | |
| 5,803,203 | * | 9/1998 | Williams, II | 182/141 |

* cited by examiner

*Primary Examiner*—Jonathan Salata
(74) *Attorney, Agent, or Firm*—Thomas L. Bohan; Patricia M. Mathers

(57) ABSTRACT

An inexpensive system for measuring and controlling the height of the platform of a lift, especially of a non-fixed lift such as fork-lift or scissors-lift. By the use of a time-monitoring microprocessor, this system carries out such measuring and controlling over a continuous range of height even though the direct-measuring operations just involve a small, discrete number of surrogate-height-markers and one or two off/on sensors. This is accomplished by incorporating into the control system (a) a geometric model relating the height of the platform to the value of a surrogate parameter and (b) dynamic model describing how the surrogate parameter changes with time during ascent and descent of the platform. With this data, the microprocessor can control the platform precisely, causing it to move to any vertical position within its normal range. The resolution is limited only by the precision of the geometric and dynamic models. This system can also incorporate in a unified way, and implement, upper and lower end-of-travel limits necessary to prevent damage to the lift mechanism, as well as instructions regarding desired platform movement whenever the platform reaches any particular key height.

20 Claims, 5 Drawing Sheets

LIFT-POSITIONING SYSTEM

BACKGROUND OF THE INVENTION

1. Field of the Invention

The present invention relates to the field of position measurement. In particular, the present invention relates to a position-measurement system used to establish and control with high precision the height of a movable platform. More particularly, the present invention relates to such a system based on relatively inexpensive sensors and microprocessors to achieve high precision at relatively low cost. More particularly yet, the present invention relates to such a system that contains as an integral component means to limit the range of travel of the movable platform. Most particularly, the present invention relates to such a system used in conjunction with fork-lifts, elevators, scissors-lifts and the like to provide an inexpensive means to precisely set and control the height of payloads supported by these lift devices.

2. Description of Prior Art

Various types of electronically, pneumatically, and/or hydraulically controlled lifts are widely used in industry to position personnel, materiel, and equipment ["payloads"] at different heights and to move them between desired heights. A simple example is an elevator used to convey payloads between different floors in a factory. More generally, these lifts are used to facilitate payload transfer and assembly (e.g., by lifting a machine being assembled to a convenient height that is well-defined). A particular lift may be portable from job to job or it may be built into a specific industrial operation; the payload capacity of such lifts can range from a few pounds to many tons. For purposes of discussion herein, the payload will be referred to as resting on a "platform," and the height of interest will be referred to as either that of the payload or of the platform or "lift-platform." Typically, platform height is controlled by "UP" and "DOWN" buttons depressed by the lift operator, with the mechanism that actually moves the platform being hydraulically, electrically, or pneumatically based. For economy of text, this discussion will be restricted to hydraulically based lift systems; however, it will be seen that the method and apparatus of the present invention can be applied regardless of the particular nature of the machinery that lifts and lowers the platform. For hydraulically based mechanisms, depressing the UP button typically energizes a pump so as to force pressurized hydraulic fluid into a piston chamber (cylinder) so as to force the piston to move; the moving piston, through linkage coupling it to the platform, raises the platform. When the platform is at the desired height, the UP button is released, which has the effect of halting the fluid flow into the cylinder and preventing that fluid that is already there from leaving the cylinder. Conversely, in this arrangement, depressing the DOWN button, again through a solenoid valve or its equivalent, allows the hydraulic fluid in the chamber to drain out and return to a supply reservoir, while ensuring that no more fluid flows in. Many variations on this are possible. If the operator has allowed the platform to overshoot the desired position, he or she will have to "jog" the UP or DOWN button so as to cause the platform height to zero in on its desired value.

If the lift is being used for manual loading/unloading, or other procedures not requiring precise, repetitive platform positioning, the procedure just described can be perfectly adequate, as long as the target heights, such as those of shelves, are clearly visible to the operator. However, in modern applications, this is often not the case, and the target height can be far above the operator's eye level, making "eyeballing" difficult or impossible. Also, there are many applications where a lift is used to repetitively convey items from one level to another, as from one automatically-operated work station to another. This type of task requires that the payload be delivered to precisely the desired level the first time, with no subsequent jogging up or down, and that it do this many times in the course of a day, or an hour. The prior art relating to lift-positioning that is precise and reproducible tends to be limited to expensive control systems used in conjunction with expensive and/or fixed lift systems. Alternatively, they are limited to applications where one is interested in placing a platform at only a few, discrete heights, such as is the case with elevators used to convey people and equipment between floors in a factory or other building, or between shelves of an inventory-storage structure in a warehouse.

The system of Allen et al. (U.S. Pat. No. 4,122,957) is directed to fork-lifts, to assist the forklift operator to position the payload at well-defined shelf heights that may be out of the range within which he or she can "eye-ball" them. It uses reflecting tape bearing shelf-specific coding on the respective shelves and a photosensor/microprocessor combination tied into the mechanism controlling the motion of the lift. Using this system, the operator can "key in" any desired shelf and the forks will automatically move to the correct level, there to retrieve or deposit some item of interest.

The system of Allen et al., useful though it is for its intended purpose, does not provide accurate height measurement/positioning anywhere but at the discrete shelf heights. Often one wishes to have absolute position determination on a continuous basis, even when the purpose of the lift mechanism, such as an elevator, is to stop at discrete floor levels. Simpson (U.S. Pat. No. 3,483,950) discloses an elevator control that uses a coded tape that moves with the elevator car, passing over a pulley in the machine room where, by photodetector techniques, the control mechanism determines the position of the tape and hence of the elevator car. This is an example of the use of a surrogate-based parameter to monitor the quantity of true interest, namely the height of the platform. The tape contains a unique code for each floor and is capable of carrying coded information regarding intermediate positions for the car. An improvement on the system of Simpson is disclosed in Payne et al. (U.S. Pat. No. 4,427,095), which teaches an elevator-control system dependent on a fixed encoded tape placed along the elevator shaft, the tape code to be detected and read by a photosensor on the elevator car. The system of Payne et al., and its refinement described in Watt et al. (U.S. Pat. No. 5,135,081), do provide a precise and reproducible method for positioning an elevator car at a myriad of positions along the elevator shaft. However, they are by their nature, limited to fixed installations and pretty much to elevators and the like. Furthermore, the resolution of position still depends on how closely the individual encoded-for positions can be imprinted on the tape or other surrogate.

Yuki et al. (U.S. Pat. No. 4,499,541) and several patents cited therein teach the measurement of the angular orientation of a rotary element attached to a forklift-driving shaft as a surrogate for the height of the forks. As must generally be true of all such surrogates, this angular orientation bears a one-to-one relationship with the height of the forks. The angular orientation of this rotary element is thus a "surrogate parameter" for the height of the platform; measuring the former gives you the latter. Thus, one of the embodiments of the method of Yuki involves putting markers around the perimeter of the referenced rotary element, and then deploying a sensor that "looks at" that perimeter and is capable of "seeing" one marker at a time. Either by counting similar markers, or, if each marker is made to be unique, recognizing markers, the sensor is able to detect and transmit information as to the instantaneous orientation of this surrogate element. This information is then used by the rest of the control mechanism to position the platform as desired. The resolution of this type of device is limited by the proximity with which the markers can be placed on the rotary element or, alternatively, the minimum size of sensor employable to read the markers. As is commonly the case with surrogates that are conveniently located and sized, a small error in determining the surrogate parameter will lead to a large uncertainty in the position of the forks.

Another surrogate-parameter-based approach to platform-height measurement and control is disclosed by Ekman (U.S. Pat. No. 4,252,213), which is directed to sky-lifts and the like incorporating two or more hydraulic rams. Indeed, its major thrust is to simplify and otherwise consolidate the means by which the platforms (buckets) of articulated lifts are varied in height and position. The method is based on using one of a variety of parameters, such as the array of hydraulic ram lengths, the array of angles between the articulated arms, and the like. As Ekman points out, given the fixed lengths of the various arms of the lift, the height and position of the platform are in one-to-one correspondence with these alternative sets. By this is meant that if one knows, for example, the angles between all five arms of the articulated lift, then one knows the height of the bucket and also the distance by which the bucket is offset from the center of the vehicle supporting it. Ekman states without further detail that the actual, absolute values of inter-arm angles, ram extensions, etc., whatever the surrogate parameter may be, are directly measured (by, for example, "electric signals"). The implication is that there is no limit to the precision with which the parameter is thereby determined. That being the case, there should be no limit to the resolution with which the bucket position is determinable. This also implies that the measurement of the surrogate-parameter arrays is carried out by relatively expensive means. Finally, it appears from Ekman that the rather complex relationship between the height/offset of the bucket on the one hand and the value of the multiplex parameter on the other (the "geometric model") is derived for each different lift and stored in the microprocessor that constitutes the heart of the control unit. In other words, there seems to be no suggestion that the microprocessor itself is used to establish the correlation.

Ochoa et al. (U.S. Pat. No. 5,695,173) discloses a scissors-lift incorporating an electronic platform-height control. The heart of this system is a series of optical sensors mounted on the platform where they are laterally deployed. Corresponding to each of the optic sensors is a series of vertically deployed light-emitters (actually reflectors) mounted on a fixed plate facing the sensor-displaying portion of the platform. By selecting a particular sensor to control the motion/position of the platform, one can with the system of Ochoa et al. cause the platform to move between a series of predetermined heights. By its nature, the system of Ochoa et al. cannot provide a general position measurement system, nor does it purport to. Rather, it provides merely a means for a closed-loop height adjustment around a small number of heights, at each of which is located a target that is directly connected to the mechanical height-setting control. In that sense, the resolution of the Ochoa et al. device is equal to the spacing of the optical sensors. The Ochoa et al. device has a further disadvantage in that the sensors are mounted directly on the platform. This placement of the sensors can impede full usage of the platform and increases the possibility of the sensors being damaged in course of operating the platform.

Separate from the need to accurately and reproducibly position the lift platform at a desired height is the requirement to keep the platform from exceeding its normal range, so as to prevent damage to the underlying mechanism. Traditionally, this requirement has been met by installing simple limiting switches at the physical locations of the upper and lower extremes of the allowable range. When the platform bumps into either of the switches, power is interrupted from the UP or DOWN control, respectively. Unfortunately, as with all exposed electromechanical devices, these limit switches are subject to damage and resulting malfunction, which can lead to costly damage to the lift mechanism. The prior art relating to precision position-control, including the system of Ekman, appears to still rely on some type of crude limiting means independent of the precision position-control.

Related to the function of the limiting switches in the traditional lifts are the "home switches" that many lift applications require, switches that signal a return of the lift to some particular "home" position, for example, to receive the next delivery of equipment or inventory. Any type of automatic platform-height control would ideally incorporate a limit-of-travel means and the option of causing the platform to return to its "home" position as a default.

Therefore, what is needed is a rugged yet inexpensive system for height-measurement and control of lift platforms, including those of non-fixed lifts such as fork-lifts and scissors-lifts. What is further needed is such a system that provides such measurement and control throughout the entire normal height range of a lift-platform, rather than just at discrete heights. What is yet further needed is such a system that incorporates end-of-travel limit switches and home switches and, in general, automatic-movement activators triggerable at any pre-determined key platform height.

SUMMARY OF THE INVENTION

It is an object of the present invention to provide a rugged and precise, yet inexpensive, platform-height-control method for fixed or portable lifts. It is a further object of the present invention to provide such a method that ensures this control on a truly continuous basis throughout the entire height range of the platform. It is a yet further object of the present invention to provide such a system that also performs the traditional functions of the end-of-range travel-limit switches and of the home switches.

The key to the accomplishment of the objects set out above is the use of basically inexpensive components, which is possible because of a concomitant reliance on the time-keeping capacity of even the most inexpensive microprocessors, to produce a method and apparatus for precisely, though inexpensively, controlling the height of a lift platform. Those few examples of the prior art that purported to provide precise control over a continuous range of heights, as opposed to just a limited number of discrete heights, still were basically discrete control systems. It was just that the discrete markers were closer together. The more closely to one another the markers are placed and the smaller the associated sensors—in an attempt to achieve ever higher resolution—the more expensive the system is to implement. Rather than go to such lengths—which generally include the use of markers that are not only closely spaced but uniquely encoded as a function of position—the present invention in its most fundamental form uses a limited number of generic markers on a surrogate element moving with the platform, a single off/on sensor that is fixed, and a microprocessor. The term "markers" has been left intentionally general up to this point. They can be Universal Product Code (UPC) labels to be read by the appropriate sensor/reader, protrusions that can mechanically trigger a microswitch, indeed anything that can, in combination with the appropriate sensor device, indicate the passage of a particular point of a particular element of a lift. For definitiveness, and because of the nature of the Preferred Embodiment of the present invention, the markers will be described as small holes in an otherwise opaque element of the lift apparatus, holes through which a photosensor mounted in proximity to the element is illuminated each time that one of the holes is aligned with it. In general there will be N such marker holes, the passage of each of which past a given point is associated with a known height of the lift platform. There will therefore be an array of N paired numbers that can be stored in the microprocessor. By causing this storing to take place, one stores the "geometric model" relating the height of the platform to the position of the surrogate element. Then, in one simple application, the microprocessor counts the number of holes that have passed the sensor as the platform rises from its "home" position (at the bottom of its range). If the microprocessor does no more than count the number of light flashes, and it has counted P such flashes, it will have enough information to specify the platform height as falling between the height associated with marker hole P and that associated with marker hole P+1 (where marker hole M is the Mth hole from the bottom).

The stated goal is to have the microprocessor be able to state the platform height precisely for positions other than those corresponding to a particular marker and, in general, with a great deal more precision than "somewhere between the height associated with marker P and the height associated with the next one." This is done in the present invention by using the microprocessor's highly precise time-keeping capacity. By their nature, solid state microprocessors, even one costing a fraction of a dollar, are able to keep time to a very high degree. Thus, if the platform heights corresponding to a number of discrete values of the surrogate parameter are known, as they are, and the rate at which that parameter changes with time—or, more properly stated, the time it takes to move between adjacent discrete values—is also known, then the microprocessor can by interpolation determine the value of the parameter, and hence the height of the platform, at any instant. This information can then be used by the microprocessor-mediated control mechanism to make the platform stop at any desired position. It is straightforward, and well known within the profession, how to program the microprocessor to store each stopping position, so that when the platform is to be moved to another height this information can be used along with the measurement/interpolation procedure just described so as to ensure that the platform moves to and stops at the new height.

In keeping with the function of the microprocessor unit in apparatus complying with the present invention, that unit will be alternately referred to as the "accumulator," a standard label in computer science for a register in the arithmetic unit of a computer in which the result of an arithmetic or logical operation is formed, and where certain operations such as sensing are performed (also call "accumulator register" or "counter").

In order to carry out the interpolation just described, the step in the method of the present invention necessary to provide continuous information and control throughout the platform-height range, a dynamic model of the platform height (and hence surrogate-parameter-value) is required. (As with the prior art, the relationship between the value of the surrogate parameter, on the one hand, and the platform height, on the other, is referred to here as the "geometric model.") As a preface for describing the dynamic model, the physics of a specific lift configuration will be described. (Although, because of the choice made above for definitiveness, this discussion will be directed at hydraulic-controlled lifts, anyone skilled in the art can translate the following observations to whatever type of mechanism is involved in a lift of interest.)

Whatever the particular details of the linkage between the platform and the hydraulic ram, the platform is forced to rise while the UP button is depressed and allowed to descend while the DOWN button is depressed (where the UP and DOWN buttons, respectively, can refer to any action, including an electronically mediated automatic action, that directs the hydraulic system to raise and lower the platform). Whereas the rate of platform rise tends to be independent of payload weight, the rate of platform descent tends to increase with the payload weight. This is because the rise is caused by (incompressible) hydraulic fluid being driven at a constant volume-flux (i.e., flow rate) into a hydraulic cylinder, whereas the platform descent is allowed to occur under the forces of gravity as the hydraulic fluid is driven out of the now-vented cylinder by the ram being pushed into the cylinder through its linkage to the platform. The rate at which the hydraulic fluid leaves the cylinder is a function jointly of the platform weight, the size of the orifice by which the fluid is draining from the cylinder, and the viscosity of the fluid. One factor controlling the viscosity of a particular type of hydraulic fluid is the fluid's temperature. In most operations, the temperature dependence of the height vs time curve during platform-descent is secondary to the weight dependence; however, when the highest accuracy is required that dependence needs to be taken into account.

Just as the geometric model is built into the accumulator, so too can be the dynamic mode, starting with the empirical data of height-vs-time during ascent and descent, respectively, for a range of payload weights and hydraulic-fluid temperatures. Any one of a number of approaches, of varying degrees of elegance, can be used to accomplish this. For example, one can convert each empirical curve to a mathematical expression, such as by setting the height equal to a polynomial in time, fit being obtained by varying the coefficients of the polynomial. There can be a single such curve associated with the UP-mode for a given lift. For the dynamic model of the DOWN-mode, one could have a family of curves related by load as a parameter. Alternatively, one can fit a mathematical function in time and weight using empirical data for a number of different weights. The same approach may be used to build in the fluid-temperature dependence.

Alternatively, one can use the accumulator itself to do the work, setting it up to store height vs time information under a range of conditions, where the absolute height of the platform is measured on a one-time basis by one of the known ranging techniques or, more simply, by videotaping the descent and ascent of the platform with a measuring tape in the background.

To consider explicitly how the accumulator will be able to determine the platform-height at any given instant t, assume that the known height of the platform at the instant $t_M$ that marker hole M passes the sensor is $H_M$ and that the change in height (the incremental height) as a function of time during ascent for the interval between the instant $t_M$ that marker hole M passes by the sensor and the instant $t_{M+1}$ that marker hole M+1 passes the sensor during ascent is $A_{M,\ M+1}$ (t), where t is the time elapsed since the marker hole M went by and $A_{M,\ M+1}$ (t) is a smooth function of t. Then at a particular instant t' ($t_M \leqq t' \leqq t_{M+1}$) is a particular value of the time, t, the height of the platform will be $H_M + A_{M,\ M+1}$ (t').

The operation during descent differs from the ascent in that the rate of height change is more dependent on the payload weight. To a lesser degree, it is also dependent on the temperature of the hydraulic fluid. Depending on the embodiment of the present invention that is being used, the weight and temperature information may be keyed in by the operator, or one or both types of data may be sensed directly and input to the accumulator. The weight could be automatically input, for example, by coupling to the accumulator the output of a piezo-electric device installed to measure the payload weight. Similarly, a thermistor or other temperature-sensing device with an temperature-dependent voltage output could be used to tell the accumulator the temperature of the hydraulic fluid.

As yet another means of calibrating the system for height measurements during descent, or for confirming that the automatically entered data is giving the correct behavior, the accumulator could use the measured time interval between two successive markers. There are clearly many variants on the basic idea. For example, there could be two or more families of markers, one set at non-regular intervals and one set at regular intervals, with a separate sensor for each family. By comparing the "blink rate" received at the two sensors, the accumulator could check for internal consistency or, depending on the specific programming and marker spacing, obtain an independent measure of whether the platform is ascending or descending. Although information about whether the platform is going up or going down is normally obtainable in a much simpler fashion, for example by monitoring the electric-control signals going to the hydraulic valves, there may be circumstances where the platform shifts for reasons not linked to the controls. For example, the lift may have been jostled in some manner as to cause the platform to move up or, more likely, down. In this circumstance and in others visualizable by those familiar with the art, it would be very helpful for the accumulator to have a means of determining height independently of the dynamic model.

In summary, the present invention is a payload-positioning system that geometrically and dynamically models the behavior of a payload-positioning device as the payload is raised or lowered. The system includes an accumulator and an incremental sensor that, in combination with a discrete position-marking means, detects well-defined increments in payload height. More particularly, the incremental sensor measures a parameter that bears a one-to-one relationship to the platform height, monitors this parameter as the platform is raised or lowered and sending corresponding pulses to the controller. Through stored data representing the geometric model linking the surrogate parameter to the height of the payload and a dynamic model that provides the payload height as a function of time between those heights corresponding to the pulses, the accumulator converts these incremental pulses into absolute platform position information and maintains a complete history of the incremental information following the last known marker-defined position of the platform. The accumulation of position data adds complexity to the controller, but it is cost-effective to do so, as this allows the use of lower-cost incremental sensors, rather than absolute-position sensors, and hence is one of the keys to achieving the object of high precision at low cost.

DETAILED DESCRIPTION OF THE INVENTION

Figure 1:
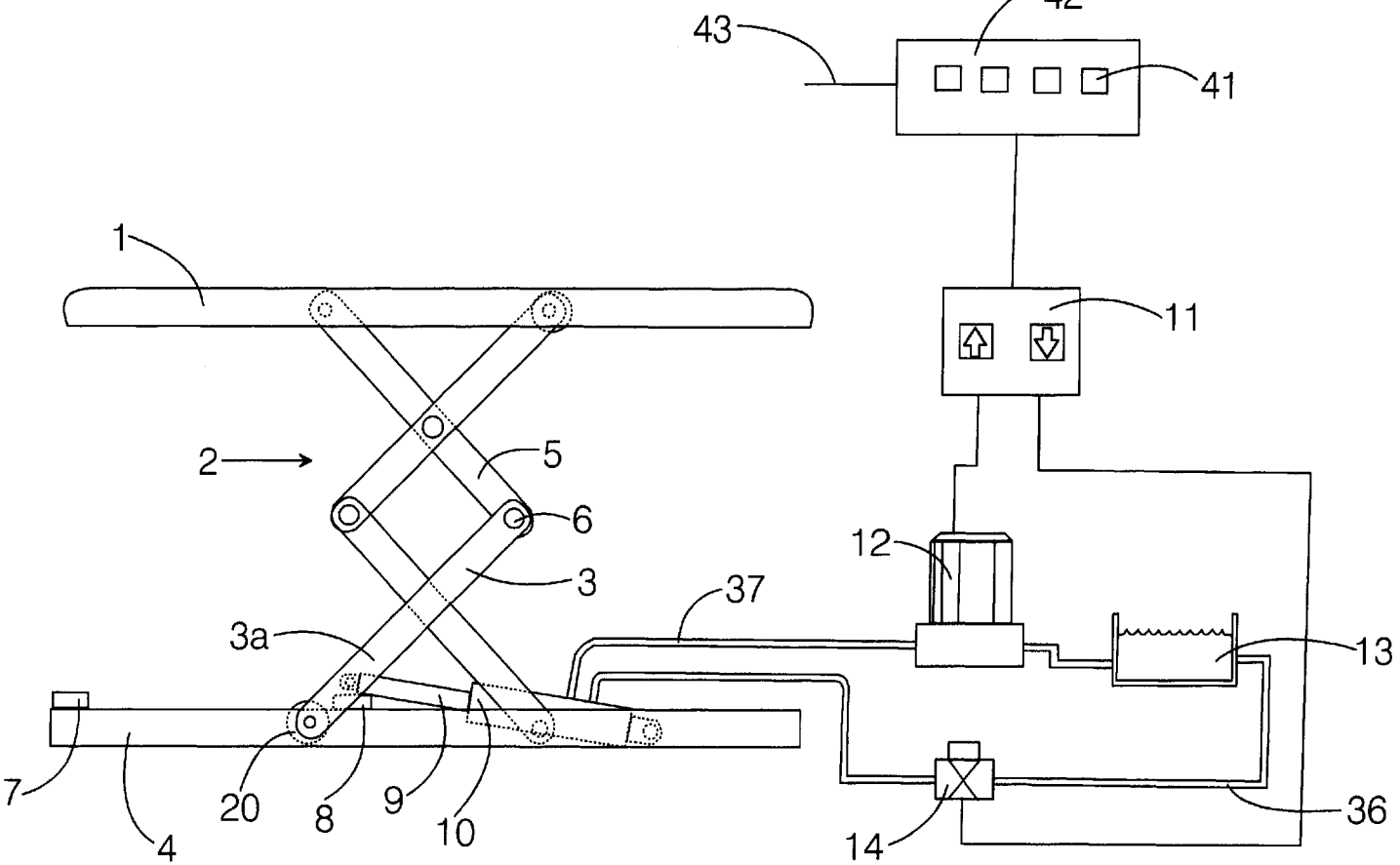
FIG. 1 shows the basic features of a typical scissors-lift, the type of lift used in implementing the Preferred Embodiment of the present invention.

The Preferred Embodiment of the present invention is a system used to establish the height of a scissors-lift platform. FIG. 1 shows the typical construction of a scissors-lift. A platform 1 is supported by a scissors support 2. Scissors support 2 includes a rollable lower scissors leg 3, an upper scissors leg 5, and a scissors support joint 6, the scissors support joint 6 pivotably connecting the upper scissors leg 5 and the rollable lower scissors leg 3. Typically, as shown in FIG. 1, a wheel 20 is attached to a lower end 3*a* of the rollable lower scissors leg 3. The lower end 3*a* of the rollable lower scissors leg 3 is typically free to roll along a base 4. A home stop 7 and an end-of-travel stop 8, shown in FIG. 1, constrain the range of travel of the rollable lower scissors leg 3. As shown in FIG. 1, the rollable lower scissors leg 3 is raised or lowered by the action of a hydraulic ram 9 attached to the rollable lower scissors leg 3 and extending from a hydraulic cylinder 10. The hydraulic cylinder 10 is under the command of a controller 11 which in turn is under the control of an accumulator 41. The accumulator 41 can receive platform-height specifications either manually from the scissors-lift operator through a keyboard input 42 or can be pre-programmed by means of software or hardware. The accumulator 41 receives signals through a feedback line 43 from a sensor (not shown in FIG. 1) configured to sense information about a surrogate parameter bearing a one-to-one relationship to the height of the platform 1.

From continuing reference to FIG. 1, it can be seen that the platform 1 is raised by activation of a hydraulic pump 12 that forces hydraulic fluid into the hydraulic cylinder 10, thereby forcing a piston 100 (within cylinder, not shown) to move distally. The piston 100 is connected rigidly to a hydraulic ram 9, that, as the piston 100 is displaced distally within the hydraulic cylinder 10, is made to move outward from the hydraulic cylinder 10. The hydraulic ram 9 thereby pushes the rollable lower scissors leg 3 to a more erect orientation, which in turns causes the entire scissors support 2 to shift to a more extended configuration, causing the platform lift 1 to rise. When the accumulator 41 senses through the feedback data arriving through input 43 that the platform is at the desired height, the accumulator 41 causes the controller 11 to shut off the hydraulic pump 12. Once turned off, the hydraulic pump 12 blocks back-flow of the fluid from the cylinder 10. The hydraulic fluid in the cylinder 10 maintains the position of the piston 100 and hence of the ram 9 necessary to hold the platform 1 at the desired height.

Should it subsequently be desired to raise the platform 1 higher, an identical procedure is followed. On the other hand, when the platform 1 is to be lowered, the accumulator 41 sends the controller 11 the signal for this lowering to take place. In response, the controller 11 causes a solenoid valve 14 to open, allowing the fluid that, trapped in the cylinder 10, has maintained the height of the platform 1 at a particular value, to flow out of the hydraulic cylinder 10 and back to a reservoir 13. This outflow from the cylinder 10 is permitted to continue until the accumulator 41 senses that the platform has fallen to the new desired height. At that point, the accumulator 41 signals the controller 11 to prevent any further descent of the platform 1. The controller 11 responds by causing the solenoid valve 14 to close, preventing further outflow of the hydraulic fluid from the cylinder 10. This halts the descent of the platform 1 and causes the platform 1 to maintain its position until further shifting of hydraulic fluid is allowed/caused to take place.

Figure 2:
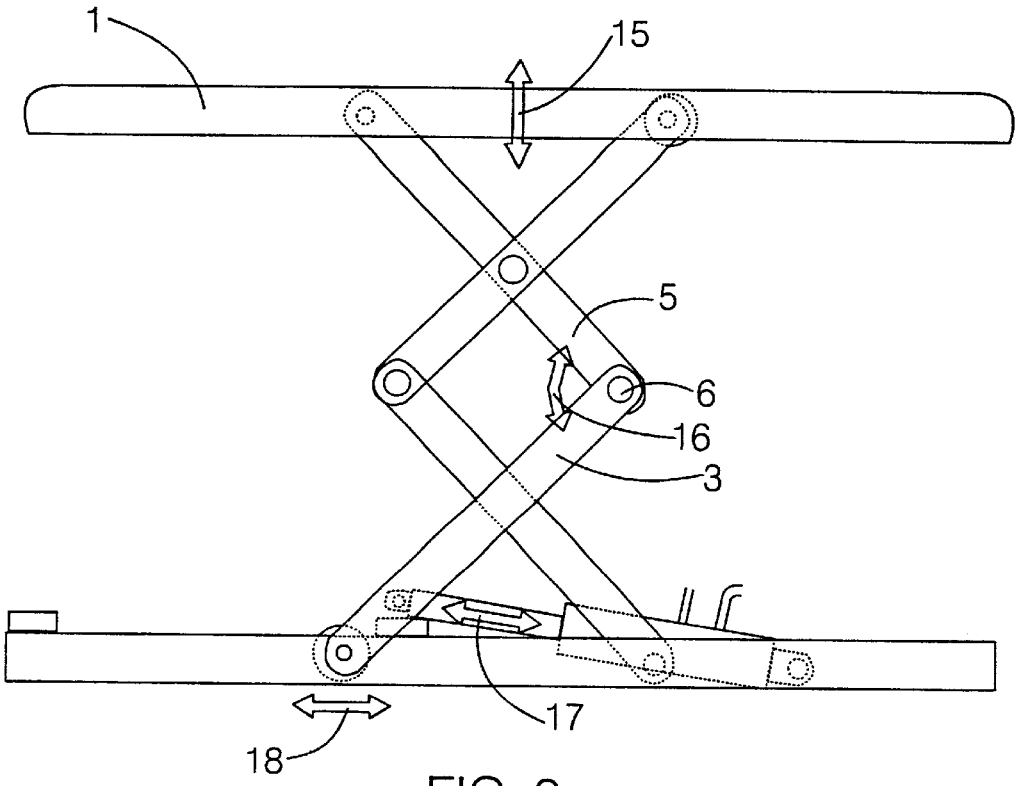
FIG. 2 shows, in a scissors-lift, a linear and an angular dimension, respectively, the changes in which can serve as surrogate parameters for sensing the change in the height of the lift platform.
Figure 3:
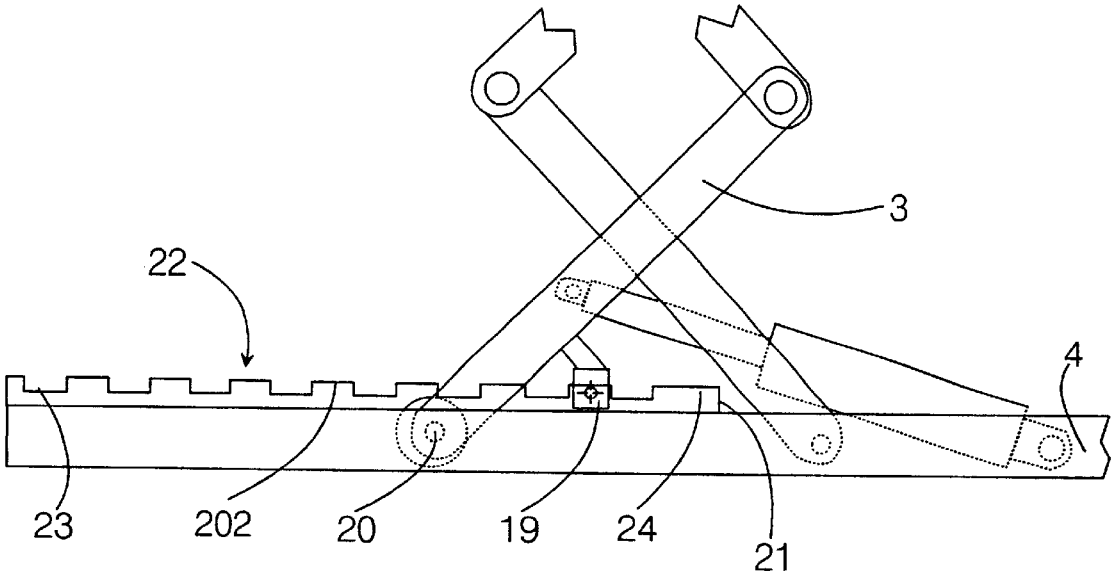
FIG. 3 illustrates with the bottom portion of a scissors-lift a displacement measurement of the roller end of a lower scissors leg, showing distinctive index markers useful for defining the home position and the end-of-travel points related to the scissors-lift platform heights.

The feedback data by which the accumulator 41 senses the height or change of height of the platform 1 comes from a sensor 19, such as is shown in FIG. 3, connected so as to measure the passage of a marker 202, which passage in turn is a measure of how some parameter used as a surrogate for the height of the platform 1 has changed. On the typical scissors-lift illustrated in FIG. 1 et seq., there are a number of parameters that change in a well-defined manner as the platform 1 changes in height. FIG. 2 shows several physical elements, the position or orientation of which constitutes such a parameter. Although these parameters have an absolute relationship to the absolute height of the platform 1, the first discussion of this relationship will be in terms of how these parameters change with a height change 15 of the platform 1.

The parameters illustrated in FIG. 2 are the primary surrogate parameters used in the Preferred Embodiment and in alternate embodiments of the invention; however, it is understood that this illustration does not limit the scope of the invention. There can be many other surrogate parameters tied to a payload-positioning device. The surrogate parameters illustrated in FIG. 2 are: a linear displacement 18 of the rollable lower scissors leg 3, a linear extension 17 of the hydraulic ram 9 relative to the hydraulic cylinder 10, and an interior angle 16 between the rollable lower scissors leg 3 and the upper scissors leg S. Of these, it is the interior angle 16 that is used in the Preferred Embodiment. Measurements of these displacements, however, do not provide linear representation of the height of the platform lift 1, but rather, must be converted from the incremental sensor data to a set of discrete heights of the platform 1 by means of the geometric model stored in the accumulator. In the Preferred Embodiment of the present invention, the accumulator 41 is used to do this calibration, wherein pairs of data linking respective markers being adjacent to the sensor 19 (as shown in FIG. 3) with the height of the platform 1 are input to the accumulator 41 during the calibration process. The pairs of data are determined by sequentially aligning the platform 1 to a series of precise preset positions and determining the corresponding values of the surrogate parameter being measured. Thereafter, the accumulator 41 converts the incremental data corresponding to the value of the surrogate parameter into absolute platform position data, based on the geometric model of the scissors-lift that has been incorporated into the program of the accumulator 41.

During a change in height of the platform 1, the accumulator 41 also maintains a complete history of the incremental information, by which is meant the sequence of markers passing the sensor 19 since the last time the lift was at a position corresponding to a given marker. FIG. 3 shows in detail the incremental measurement of the linear position of the rollable lower scissors leg 3 as it moves back and forth along the base 4 on wheel 20. In one embodiment of the present invention, a rack 21 is attached to the base 4. The rack 21 has a plurality of position markers 22. The sensor 19 detects the passage of each of the plurality of position markers 22 as the rollable lower scissors leg 3, rolling along base 4, moves the sensor 19 across the rack 21. Sensor 19 may be based on optical, magnetic, or capacitive changes, or it may be a simple mechanical switch or any other type of sensor that can reliably detect the passage of each of the plurality of position markers 22, that is markers on a position marker element in such a way as to distinguish one such marker from the next. In the Preferred Embodiment, shown in FIG. 5, it is an optical sensor that has a first voltage output when one of the plurality of position holes 29 is aligned with it and a second, different, voltage output for positions in which none of the holes is aligned. In the configuration shown in FIG. 3, the plurality of position markers 22 is predominantly evenly spaced along the rack 21. However, a first end position 23 corresponding to a lowest permitted height of the platform 1 has an extra long gap (a "low") that must cause a signal in the sensor 19 that is recognizable by the accumulator 41 as the home position. Similarly, a second end position 24 has associated with it an extra long ridge (a "high") mark, that must cause a signal in the sensor 19 that is recognizable by the accumulator 41 as indicating the upper end-of-travel position for the platform 1. Other features may be used to distinguish certain positions including a mark distinctively short in dimension, an extra mark, or an out-of-position mark. Any mark variant that can be detected reliably by the accumulator 41 as distinctive can be used to mark a position of interest, such as a platform height which matches the height of another workstation.

Figure 4:
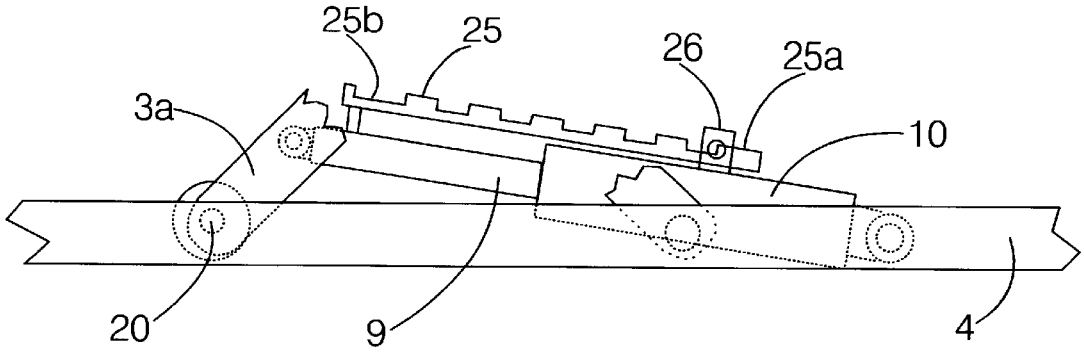
FIG. 4 illustrates a measurement of the linear displacement of the piston connected to the hydraulic ram used for changing the height of the lift-platform of a scissors-lift.

FIG. 4 shows an embodiment of the present invention in which a ram-position sensor 26 detects the linear extension 17 of the hydraulic ram 9 from the hydraulic cylinder 10, as shown in FIG. 2, relative to the hydraulic cylinder 10. As shown in FIG. 4, this embodiment includes a rack 25 having predominantly regular markers, an irregular "low" marker **25*b* at one end of the rack 25 to designate the home position, and an irregular "high" marker 25*a* at the other end of rack 25 to designate the end-of-travel position. The rack 25 is fixedly attached to the hydraulic ram 9 and can slide along the hydraulic cylinder 10. The ram-position sensor 26 is fixedly mounted on the hydraulic cylinder 10. As the hydraulic ram 9 extends and retracts relative to the hydraulic cylinder 10, the rack 25 slides back and forth along the hydraulic cylinder 10, allowing the sensor 26 to detect the markers on the rack 25**.

Figure 5:
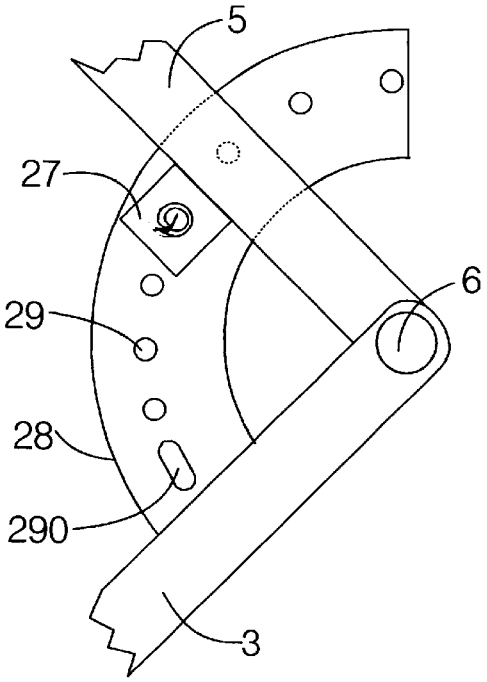
FIG. 5 shows an angular position-marking plate and sensor for measuring the angular displacement of a scissors joint and illustrates the non-linear relationship of the angular displacement to the height of the lift.

FIG. 2 combined with FIG. 5 shows the surrogate parameter of the Preferred Embodiment of the present invention; here, it is the angular displacement 16 that forms the basis for monitoring the position of the platform 1. As shown in FIG. 5, an angular position-marker plate 28 is rigidly attached to the rollable lower scissors leg 3 of the scissors support 2 and an angular-displacement sensor 27 is rigidly attached to the upper scissors leg 5, which is pivotably attached to the rollable lower scissors leg 3 by the pivot joint 6. The angular-displacement sensor 27 detects the passage of each of the plurality of position holes 29 as the platform lift 1 is raised or lowered. (It is the plurality of position holes 29 that constitutes the "markers" referred to in the more general discussions of this invention.) The plurality of position holes 29 as shown in FIG. 5 does not consist of evenly spaced holes on the angular-position plate 28, but, rather, has an inter-hole spacing that is a monotonically increasing function of the angular displacement 16. In the Preferred Embodiment of the present invention, this inter-hole spacing provides some control advantages in that it compensates for the non-linear relationship between the angular displacement 16 and the platform vertical displacement 15. (As can be seen from FIG. 1, a given change in the angular displacement 16 causes a bigger change in the vertical displacement 15 when the platform 1 is near its lowest position than when it is at higher levels.) This compensation can simplify the transfer function implemented within the accumulator 41 to derive the vertical displacement 15 of the platform 1 based on the angular displacement 16. It is understood that the angular-displacement sensor 27 may employ optical, magnetic, or mechanical switch detection of the position marker features which may be holes, ridges, or any other characteristic which will provide pulses as the angle between the rollable lower scissors leg 3 and the upper scissors leg 5 changes about the pivot joint 6. In the Preferred Embodiment, the angular-displacement sensor 27 is an optical detector, as described above, which detects passage of each of the plurality of position holes 29.

As shown in FIG. 5, a first specific position hole 290 is provided with a distinctively different characteristic so that it can be readily recognized by the angular-displacement sensor 27 working in conjunction with the accumulator 41, as the lower limit.

Figure 8:
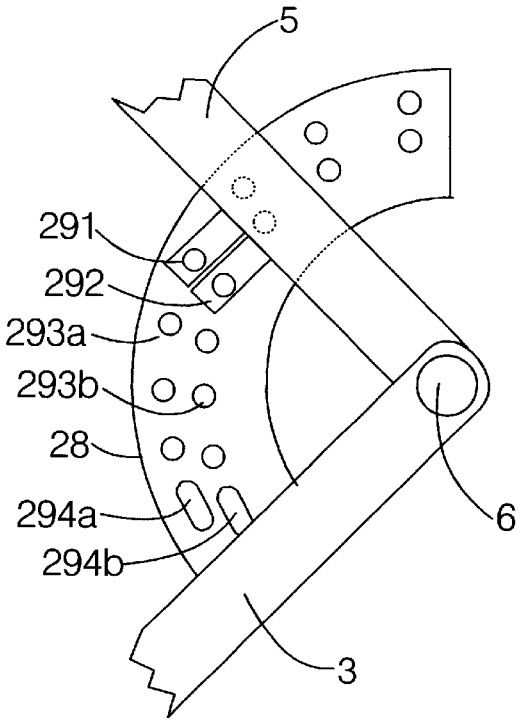
FIG. 8 shows an angular position-marking plate with two sensors and two sets of position markers so arranged to provide direction information as well as position information to the accumulator.

FIG. 8 shows the same angular-position plate of FIG. 5 where the single set of position markers 29 has been replaced with a duality of position markers 293*a* and 293*b*. The single angular-displacement sensor 27, shown in FIG. 5, has been similarly replaced with a duality of angular sensors 291 and 292. The sensors are arranged so that sensor 291 detects position markers 293*a* and sensor 292 detects position markers 293*b*. The position markers 293*a* and 293*b* are arranged such that, as the interior angle between the uppers scissors leg 5 and the rollable lower scissors leg 3 increases, sensor 292 detects the presence of one of the position markers 293*b* first, then sensor 291 detects the presence of one of the position markers 293*a*. Thus, when the lift platform 1 is ascending, the change in position is indicated by the passing of a number of position markers (say, of position markers 293*a*) and the direction is indicated by whether sensor 291 or sensor 292 first detects a position marker 293*a* or 293*b*, respectively. If sensor 291 first detects one of the position markers 293*a*, the lift platform 1 is descending. If sensor 292 first detects one of the position markers 293*b*, the lift platform 1 is ascending. The added information regarding direction of travel is useful where the lift position may be altered by some means external to the lift controller 11. This may happen due to application of a heavy load, due to vibration, or due to settling of the lift platform 1 over time due to leakage of hydraulic fluid out of the hydraulic cylinder 12 that causes the lift platform 1 to ascend. FIG. 8 also shows the inclusion of "home" position markers 294*a* and 294*b* which indicate when the lift platform 1 has been lowered to its "home" position. FIG. 8 also shows a non-uniformity of the spacing of the position markers 293*a* and 293*b*; such non-uniformity being of assistance in production of the geometric model for the lift.

On a scissors-lift, as used in the Preferred Embodiment of the present invention, the hydraulic pump 12 is a constant-displacement pump, which delivers a fixed volume of hydraulic fluid per unit time. Since for present purposes, the hydraulic fluid is incompressible, this means that over the range of weights that the hydraulic pump 12 will normally operate, the ascent rate of the platform 1 is mostly independent of the weight on the platform 1. Although the rate at which the hydraulic ram 9 advances is fixed, and depends only on the size of the hydraulic pump 12, the ascent rate of the platform 1 itself depends on the instantaneous position of the platform 1. This is related to the linkage between the hydraulic ram 9 and the platform 1.

Figure 6:
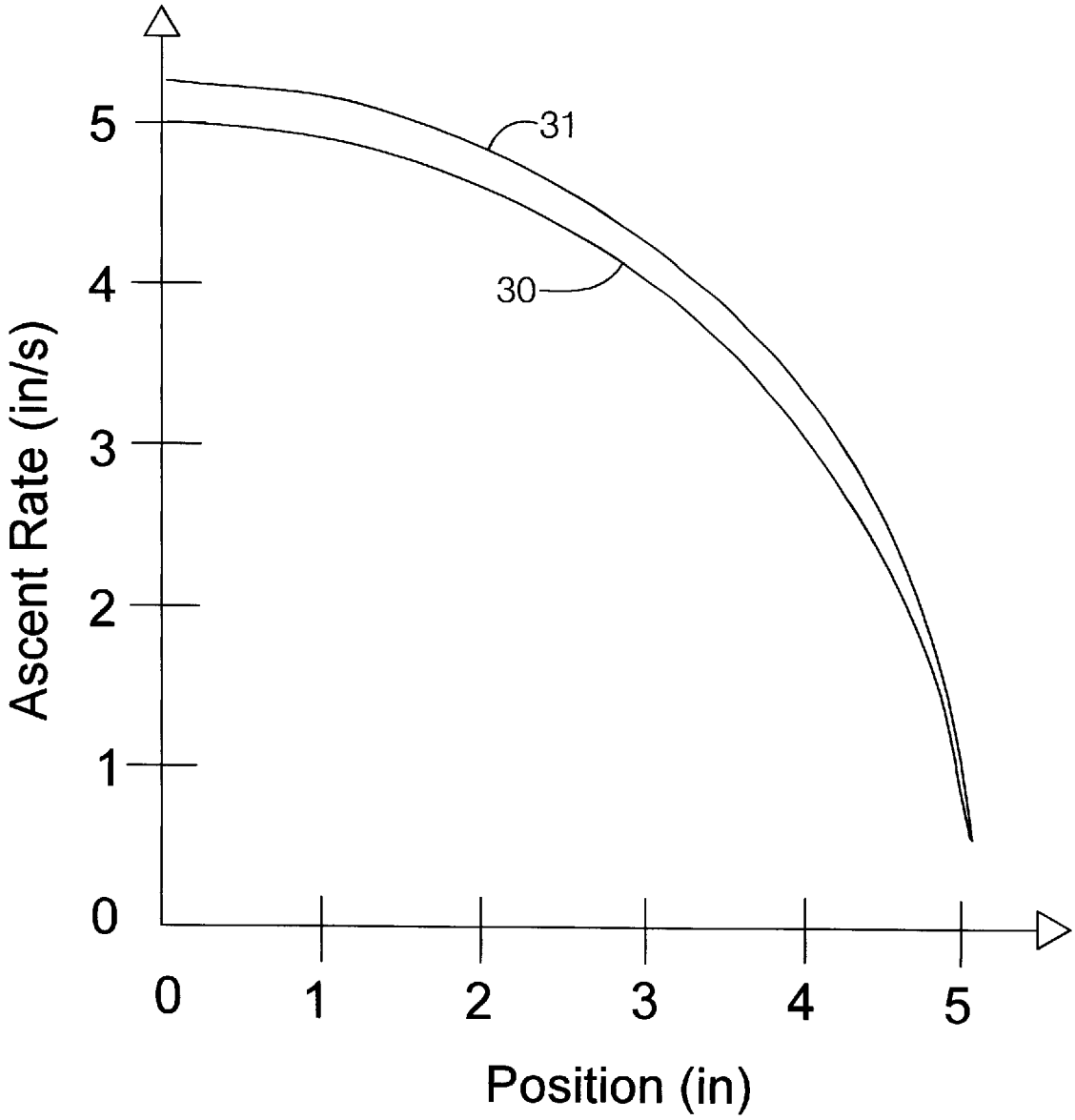
FIG. 6 shows a scissors-lift platform ascent rate dependence on platform position and platform load.

FIG. 6 shows, for the scissors-lift configuration of the Preferred Embodiment of the present invention, the ascent rate of the platform 1 as a function of the height of the platform 1 for two different extremes of load on the platform 1. Curve 30 is for a heavy load; curve 31 is for no load beyond the weight of the platform 1 itself. Units of "inches" for position and "inches/sec" for the ascent rate are used for definiteness; obviously any mutually commensurate units for displacement and rate of displacement could be used. The "zero" of the horizontal axis—the "Position" axis—corresponds to the platform 1 being in its lowest (home) position. It can be seen that the ascent rate is greatest (approximately 5 inches/sec for the particular scissors lift characterized in FIG. 6) at the lowest platform heights, and falls off as the height increases. That this is to be expected can be seen from the geometry of the scissors-lift, as shown in FIG. 1. As is illustrated in FIG. 6, the ascent rate is relatively insensitive to platform load, with the rate being about 4% lower for a heavy load than it is for a light load.

In contrast to the ascent rate of the platform 1, its descent varies significantly with position and with payload weight and, to a lesser extent, with the temperature of the hydraulic fluid. This is because that descent rate is controlled by the rate at which the fluid flows out of the hydraulic cylinder 10 under the force of gravity actiing on the platform 1 and thus on the piston. More specifically, the flow rate depends on the fluid viscosity, the effective size of the orifice through which the fluid flows out of the hydraulic cylinder 10, and the force driving the hydraulic ram 9 back into the hydraulic cylinder 10. The size of the orifice is fixed; the pressure in the hydraulic cylinder 10, however, is not constant, but is a function of the lift load, i.e., the greater the load, the greater the pressure in the cylinder. Lowering and raising the platform 1 under various known load conditions (full-rated load, no load, an intermediate known load), will generate a family of curves for the rate of descent and ascent under known conditions. Also, there will be a temperature dependence, since the viscosity of the fluid goes down as the temperature rises, resulting in more rapid descent at each instantaneous position of the platform 1 the higher the fluid temperature.

Figure 7:
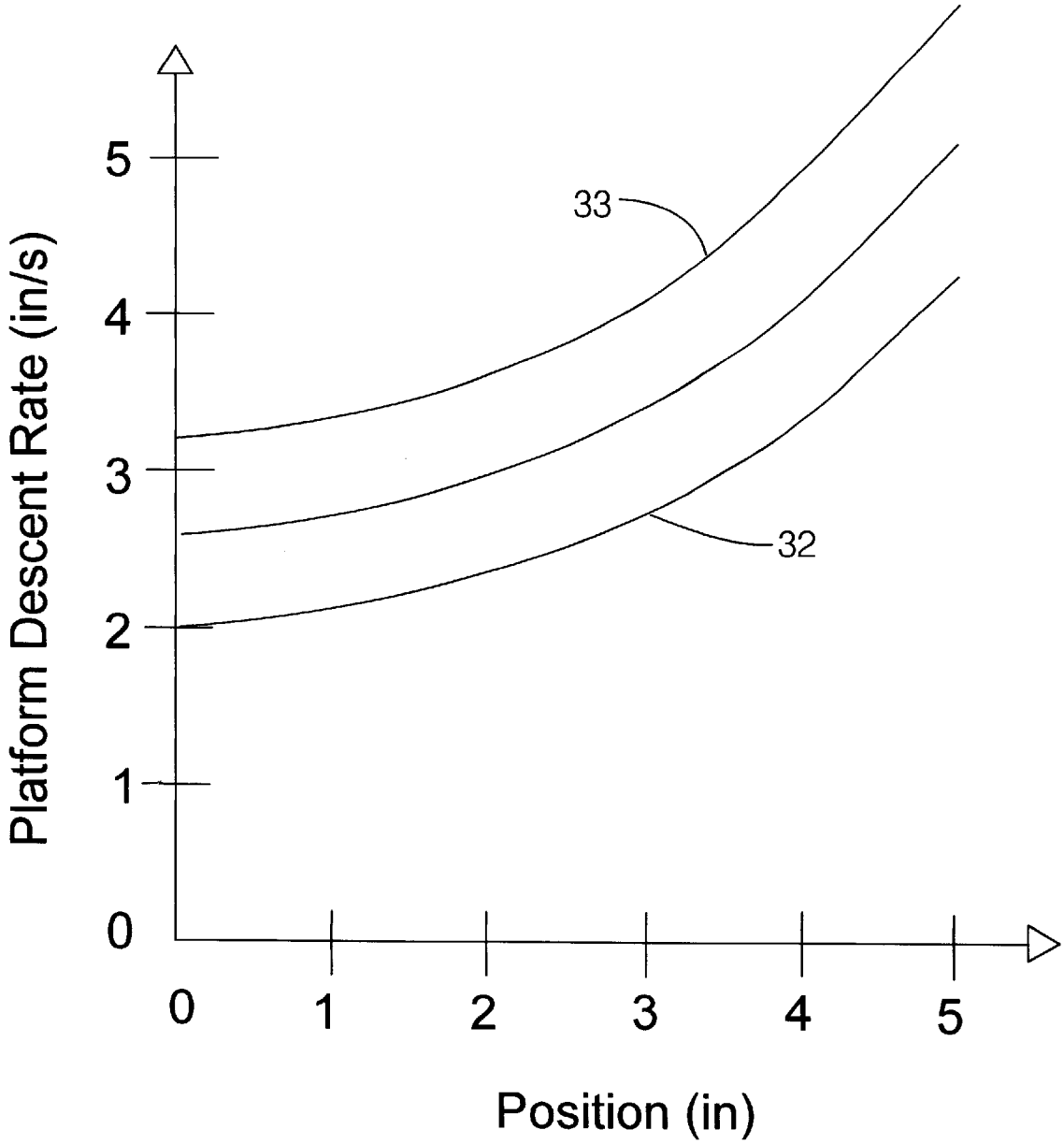
FIG. 7 shows a scissors-lift platform descent rate dependence on platform position as a family of curves, the parameter defining individual family members being the platform load.

FIG. 7 shows, for the same scissors-lift depicted in FIG. 6, a family of curves depicting the descent rate of the platform 1 as a function of platform position. The gross platform weight (weight of the platform plus weight of the payload) is again the parameter. For this graph, the "zero" of the "Position" axis is the highest position of the platform 1. Thus, as in FIG. 6, it can be seen that the rate of change becomes higher, the lower the platform 1 is. More importantly, it can be seen that the descent rate has a much stronger dependency on weight than does the ascent rate. In FIG. 7, curve 32 shows the descent-rate characteristic for the empty platform (no load); curve 33 shows the descent-rate characteristic when this particular scissors-lift is carrying its maximum-rated load.

Based on the family of curves generated for the particular scissors-lift used in the Preferred Embodiment, the accumulator 41 can determine the actual descent rate, for example, by evaluating time between two pulses in conjunction with the distance between the heights corresponding via the geometric model to these two pulses, and can estimate by interpolation the actual load by superimposing the actual descent rate on the family of curves shown in FIG. 7 which are associated with the descent rate of the lift under different loads. This can be done at the beginning of the descent by using the known position data. After passing another known point, meaning a point at which the optical sensor 19 is aligned with one of the position holes 29 thereby causing the sensor 29 to output a voltage which the accumulator 41 then correlates with the actual height of the lift as stored in the accumulator 41 in the geometric model the electronic control can estimate the load from, the descent rate under the actual load. This dynamic model is used to interpolate position data between known position pulses. At each position pulse (going up or down), the position of the lift platform calculated from the dynamic model is corrected to match the exact position given by the geometric model thus continuously correcting a calculated value for said rate of descent or (ascent). Coefficients calculated from the calibration tests when determining the geometric model can also be applied to this dynamic model.

While a Preferred Embodiment is disclosed herein, this is not intended to be limiting. Rather, the general principles set forth herein are considered to be merely illustrative of the scope of the present invention and it is to be further understood that numerous changes may be made without straying from the scope of the present invention.

I claim:

1. A system for establishing a vertical position of a lift platform, said system comprising an accumulator, a sensing device in electrical communication with accumulator, said sensing device being adapted to measure a surrogate parameter for said vertical position, said accumulator incorporating a geometric model relating said surrogate parameter to said vertical position, wherein said surrogate parameter is related to location of a position-marking element, said position-marking element being mechanically linked to said platform by said geometric model and wherein said position-marking element has a plurality of position markers.

2. The system as claimed in claim 1, wherein said accumulator further incorporates a dynamic model relating said surrogate parameter to said vertical position as a function of time during ascent and descent of said platform.

3. The system as claimed in claim 2 wherein said lift platform is a part of a scissors-lift.

4. The system as claimed in claim 3, wherein said surrogate parameter is an angle between a lower scissors leg and a higher scissors leg coupled to said lower scissors leg at a pivot point.

5. The system as claimed in claim 3, wherein said surrogate parameter is a linear displacement of a hydraulic ram used to vary said vertical position of said platform.

6. The system as claimed in claim 3, wherein said surrogate parameter is a linear displacement of a lower rollable scissors leg along a support base.

7. The system as claimed in claim 3, wherein said sensing device is a photodetector.

8. The system as claimed in claim 3, wherein said sensing device is a magnetic sensor.

9. The system as claimed in claim 3, wherein said sensing device is a mechanical switch detector.

10. The system as claimed in claim 3, wherein said plurality of position markers includes a "home" position marker.

11. The system as claimed in claim 3, wherein said plurality of position markers includes an end-of-travel position marker.

12. The system as claimed in claim 3, wherein said position-marking element is a rack and said position markers are a series of alternating troughs and ridges.

13. The system as claimed in claim 3, wherein said position-marking element is a plate and said plurality of position markers is a series of holes in said plate.

14. A system for establishing a height for a platform of a scissors-lift, said system comprising (a) a microprocessor (b) a position-marking element attached to a rollable lower leg of said scissors-lift, wherein said position-marking element is a metal plate, said plate bearing a plurality of first position markers, (c) a first sensing device fixed close to said plate so that said first sensing device can sense a passage of each of said plurality of first position markers, (d) a connection between said first sensing device and said microprocessor such that said first sensing device can send notice of said passage to said microprocessor, wherein said microprocessor is programmed to contain information regarding how said platform ascends and descends as a function of time and of payload, said information based in part on a known correlation between each said passage of one of said plurality of first position markers past said first sensing device and in part on a time-keeping function of said microprocessor.

15. A system as claimed in claim 14, wherein said system also contains a payload-measuring device that generates an electrical signal, and a means of coupling said electrical signal into said microprocessor so that said microprocessor can automatically take said payload into account in responding to a command to establish said platform at a desired height.

16. A system as claimed in claim 15 wherein said first position markers are holes in said plate through which light is allowed to illuminate said first sensing device, wherein said first sensing device is a photocell, and wherein said holes include a first-end hole and a second-end hole such that said first-end hole and second-end hole each causes a signal in said photocell such that said microprocessor prevents said platform from moving outside of an allowed range of travel.

17. A system as claimed in claim 16 wherein a second sensing device and a plurality of second position markers are included so as to facilitate a determination by said microprocessor of an absolute position of said platform and a determination by said microprocessor of a direction-of-motion of said platform.

18. A method for inexpensively and precisely establishing a vertical position for a lift platform using a microprocessor, an incremental sensing device, and a position-marking element having a position-marking-element position bearing a one-to-one relationship to said vertical position, wherein said position-marking element contains a plurality of position markers, said method comprising:

a) electronically connecting said incremental sensing device to said accumulator so as to allow said sensing device to transmit pulses to said accumulating controller as said sensing device detects a passage of said position markers as said position-marking element moves;

b) calibrating said accumulator by raising and lowering said payload positioning system under known load conditions whereby information of rates of ascent and descent of said platform as a function of load are stored within said accumulator;

c) providing said accumulator with an input device that allows a lift operator to input any desired value for said vertical position;

d) configuring said accumulator with a through a time-keeping function of said accumulator and said, said accumulator is able to use an elapsed time to establish said platform at said desired value for said vertical position, e) entering said desired value into said accumulator.

19. The method as claimed in claim 18 wherein said calibrating said accumulator is accomplished by a) converting information from each pulse from said sensing device to a known position of said payload positioning device, b) determining a rate of descent or ascent of said payload positioning device;

c) determining an actual weight of a payload;

d) determining a position of said payload positioning device between any two of said plurality of position markers; and, e) continuously correcting a calculated value for said rate of descent or ascent.

20. A method of establishing a vertical position of a platform of a lift, using an accumulating controller, an incremental sensing device, and a position-marking element having a plurality of position markers, said method comprising the steps of:

a) electronically connecting said incremental sensing device to said accumulating controller so as to allow said sensing device to transmit pulses to said accumulating controller as said sensing device detects said position marks from said position-marking element;

b) raising and lowering said payload positioning system under known load conditions to calibrate said accumulating controller; and c) entering a weight of a payload into said accumulating controller by means of a weight sensing device;

d) determining a precise position of said platform device at any one mark of said plurality of position marks; and e) estimating a position of said payload positioning device between any two of said plurality of position marks.

* * * * *